US009074306B2

(12) United States Patent
Preus

(10) Patent No.: US 9,074,306 B2
(45) Date of Patent: Jul. 7, 2015

(54) BELT

(75) Inventor: Stephan Preus, Einbeck (DE)

(73) Assignee: E. Oppermann, Einbeck, Mechanische Gurt- und Bandweberei GmbH (DE)

( * ) Notice: Subject to any disclaimer, the term of this patent is extended or adjusted under 35 U.S.C. 154(b) by 519 days.

(21) Appl. No.: 13/139,776

(22) PCT Filed: Sep. 17, 2009

(86) PCT No.: PCT/EP2009/006710

§ 371 (c)(1),
(2), (4) Date: Jun. 15, 2011

(87) PCT Pub. No.: WO2010/069413

PCT Pub. Date: Jun. 24, 2010

(65) Prior Publication Data

US 2011/0250808 A1 Oct. 13, 2011

(30) Foreign Application Priority Data

Dec. 19, 2008 (DE) ..... 20 2008 016 802 U

(51) Int. Cl.
*D03D 1/00* (2006.01)
*D03D 13/00* (2006.01)
*D03D 15/08* (2006.01)

(52) U.S. Cl.
CPC ..... *D03D 1/0005* (2013.01); *D03D 1/0094* (2013.01); *D03D 13/00* (2013.01); *D03D 15/08* (2013.01); *D03D 13/002* (2013.01)

(58) Field of Classification Search
CPC ..... D03D 1/0005; D03D 7/00; D03D 13/004; D03D 15/08; D03D 17/00
USPC ..... 442/182, 184, 203, 208
See application file for complete search history.

(56) References Cited

U.S. PATENT DOCUMENTS 3,897,106 A * 7/1975 Takada ..... 297/471
4,331,729 A * 5/1982 Weber ..... 442/191

(Continued)

FOREIGN PATENT DOCUMENTS

CA 2036356 A1 8/1991
CN 1088527 A 6/1994

(Continued)

OTHER PUBLICATIONS

Chinese Office Action dated Oct. 10, 2012 in related application No. 200980148915.4.

*Primary Examiner* — Andrew Piziali
(74) *Attorney, Agent, or Firm* — Fox Rothschild LLP

(57) ABSTRACT

The fabric structure of a belt intended for use as a vehicle safety belt is characterized by warp (1) and weft (3) threads, wherein the warp threads (1) extend in the lengthwise direction of the belt (2) and the weft threads (3) extend in the transverse direction thereto, wherein in the load-free state the warp threads (1) are looped around the weft threads (3) which extend in a straight line and wherein at least in a lengthwise section of the belt the weft threads (3) are formed in such a manner that they can extend in length in comparison to the warp threads (1). In this manner, the risk of injury to vehicle occupants during an accident, thus when a load is applied in the lengthwise direction of the belt, is reduced by virtue of the fact that the warp threads which are not able to extend in length relative to the weft threads starting from their shape looped around the weft threads (3) are aligned in a straight line in accordance with the applied load, so that a displacement force is exerted on the weft threads (3) and these are stretched to form a shape which is now looped around the warp threads (1), so that the warp threads are moved away from each other and the belt band width is increased.

13 Claims, 2 Drawing Sheets

(56) References Cited

U.S. PATENT DOCUMENTS

| | | | | |
|---|---|---|---|---|
| 4,563,384 | A * | 1/1986 | Wiehe et al. | 442/153 |
| 5,385,367 | A | 1/1995 | Tanaka et al. | |
| 5,390,953 | A | 2/1995 | Tanaka et al. | |
| 5,784,717 | A * | 7/1998 | Singer | 2/79 |
| 5,830,811 | A | 11/1998 | Tang et al. | |
| 7,827,829 | B2 * | 11/2010 | Fujikawa | 66/195 |

FOREIGN PATENT DOCUMENTS

| | | | |
|---|---|---|---|
| DE | 4104516 | A1 | 8/1991 |
| DE | 4326499 | A1 | 3/1994 |
| DE | 10050644 | A1 | 4/2002 |
| DE | 20113090 | U1 | 7/2002 |
| DE | 69722037 | A1 | 2/2004 |
| JP | 6-299435 | A | 10/1994 |
| JP | 2001-106023 | A | 6/2005 |

* cited by examiner

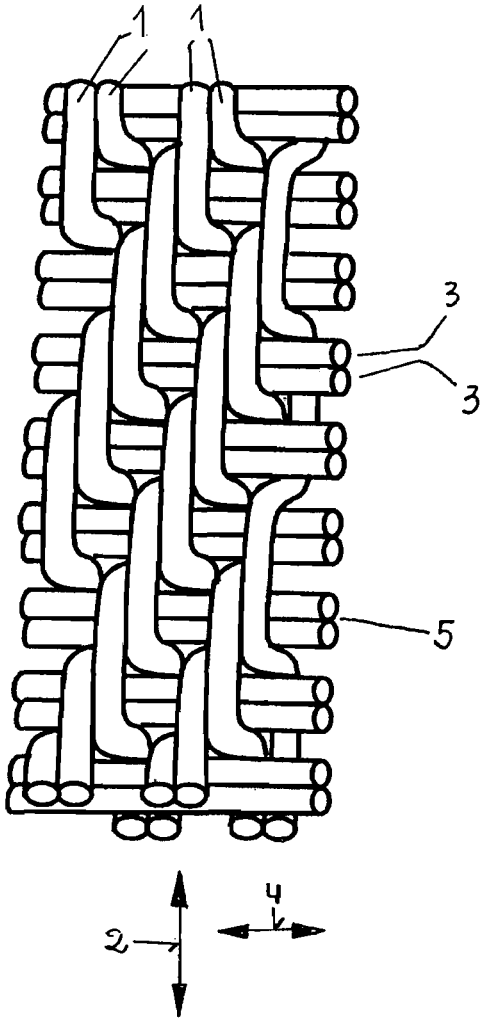
Fig. 1
Fig. 2,
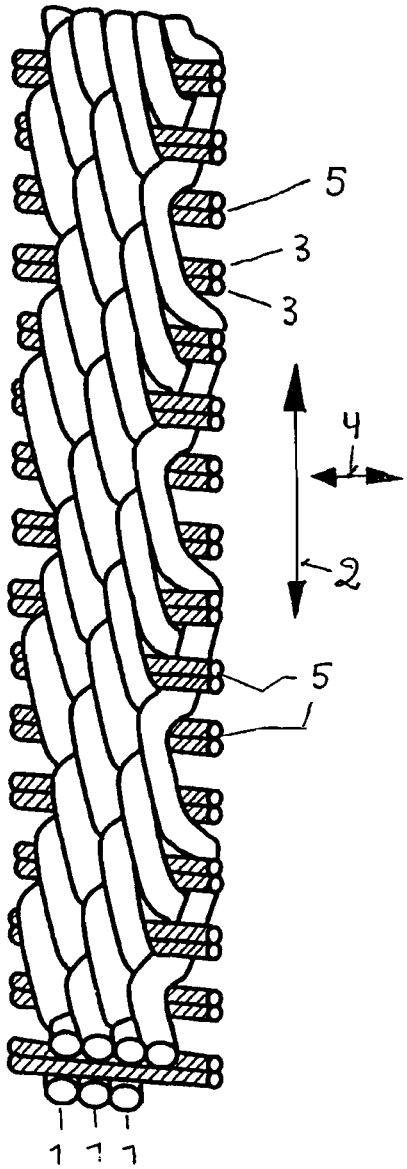

BELT

CROSS REFERENCE TO RELATED APPLICATIONS

This application is the U.S. National Phase application of PCT International Application No. PCT/EP2009/006710, filed Sep. 17, 2009, which claims priority to German Patent Application No. 20 2008 016 802.3, filed Dec. 19, 2008.

FIELD OF THE INVENTION

The invention relates to a belt for use as a vehicle safety belt having a fabric structure consisting of warp threads and weft threads, wherein the warp threads extend in a longitudinal direction corresponding to the load direction of the belt and the weft threads extend in a transverse direction thereto and wherein in the load-free state the warp threads are looped around the weft threads and the weft threads extend substantially in a straight line with respect thereto.

BACKGROUND OF THE INVENTION

The safety belts used in motor vehicles, frequently used in conjunction with belt pre-tensioners which are controlled by the operating state of the vehicle, are generally 46 mm to 48 mm wide. They are intended to protect the occupant of the vehicle during an accident from uncontrolled swirling movements within the vehicle, which are associated with considerable risks of injury, but without excessively limiting the freedom of movement of the occupant under normal operating conditions. These safety belts have proved to be extremely effective in practice and since their general introduction into road transport they have made a significant contribution to reducing serious injuries as a result of an accident.

In contrast, the width dimensions actually used of such a belt are not regarded as being optimal, since during an accident, in accordance with the value of the forces which are to be transmitted via the belt, localised excessively high loadings, which are concentrated in accordance with the width dimensions, can occur on the body with the associated risks of injury, which can be considerable in particular when the body of the vehicle occupant is in an unfavourable position. These width dimensions actually used were also introduced at that time under the consideration of representing an increase in travel safety, whilst on the other hand impairing the travel comfort as little as possible.

In order to reduce the risks of injury whilst maintaining the travel comfort a safety belt system is known from the document DE 43 26 499 A1, whose belt comprises a tube-like structure which is connected to a gas-generating device. The gas-generating device which can be activated by a delaying sensor is adapted to generate a high pressure gas which influences the said structure and which is designed with the proviso that it practically does not extend in the lengthwise direction of the belt at all, but considerably extends in the transverse direction thereto, thus increasing the width of the belt in an emergency situation and hereby in association reducing the risk of injury of the vehicle occupant who is strapped in. The structure consists of two belt-band base fabric parts which comprise individually the width of a conventional safety belt and which are stitched together along their longitudinal edges, whose fabrics consisting of warp and weft threads are each characterised by the fact that the warp threads extend in the lengthwise direction and the weft threads extend in the transverse direction to the belt band. To demonstrate the different stretching properties mentioned in the introduction in the transverse and lengthwise direction of the belt, the warp threads consist of an extremely rigid material which practically does not stretch, whereas the weft threads in contrast consist of a rubber-like stretchable material, e.g. polyurethane. In order to achieve these stretching properties, a not inconsiderable expenditure is necessary which is expressed in a tube-like belt structure, a delaying sensor and a gas-generating device.

SUMMARY OF THE INVENTION

It is the object of the invention to improve a belt of the type mentioned in the introduction to such an extent that the localised loading as a result of an accident and the associated risk of injury to the vehicle occupant are reduced in a more convenient manner. This object is achieved in the case of such a belt by virtue of the features described herein.

In accordance with the invention fabric structures are used for the belt, in which the weft threads have a significantly greater ability to extend in length in comparison to the warp threads. This means that, under a load which is applied in the lengthwise direction of the belt, the warp threads which cannot extend in length relative to the weft threads are aligned, in accordance with the load, in a straight line starting from their structure which is looped around the weft threads, so that insofar as a displacement force is exerted on the weft threads, these stretch starting from their original straight line to become a structure looped around the warp threads. Thus, in the event of a loading of the belt in its lengthwise direction, a lengthening of the weft threads occurs in accordance with a straight alignment of the warp threads which are not or hardly able to extend in length. In dependence upon the load applied, the original fabric structure, characterised by straight weft threads and warp threads looped around said weft threads, is replaced by such a structure in which the warp threads are aligned in a straight line and the weft threads are looped around said warp threads. In this case, the weft threads are displaced in the intermediate space between every two warp threads, so that these are moved away from each other in a lateral direction and in this respect the width of the belt band increases.

The difference with respect to the ability to extend in length of the warp and weft threads is thus designed to such an extent that as a result of inserting weft threads between two adjacent warp threads under a defined loading which during an accident has to be absorbed by a vehicle safety belt, the width dimension of the belt is increased. The ability to extend in length which is necessary in this respect with respect to a warp thread which is virtually hardly able to extend in length is a prerequisite by virtue of this specific function.

As a basic principle, it is possible to use in such a fabric structure all yarns which are known to the person skilled in the art of weaving technology, which have sufficient strength properties and which when used as warp threads are not able or are hardly able to extend in length and which when used as weft threads in contrast thereto have a significantly increased ability to extend in length.

The use of such a fabric structure as a vehicle safety belt means that the said belt can be manufactured in common width dimensions and accordingly can be used easily in conjunction with conventional retractor systems. A particular advantage for the vehicle occupant is, however, its property of increasing its width dimension under loading, so that on the basis of a greater contact area on the body of the vehicle occupant a risk of injury is reduced.

In accordance with an aspect of the invention, those yarns which for reasons of their material already have sufficient elasticity are used as weft threads. These threads can be used as individual components or also in combination with other materials, e.g. in the form of core yarns.

In accordance with one or more other aspects of the invention, the yarns used as weft threads are those yarns which with regard to demonstrating sufficient ability to extend in length have been changed in their structure. This provides the advantage, for example, that warp and weft threads can consist of the identical material, so that the belt manufactured in this way is characterised by a purity of type. Ultimately, with a view to demonstrating sufficient ability to extend in length, it is possible to combine measures, which aim to change the structure of the thread, with the selection of a specific material, so that, for example, a thread which for reasons of its material is already elastic can be subjected additionally to a structural treatment in order to influence further the ability to extend in length.

A type of fabric modified in the above-mentioned sense can homogenously affect the entire belt length. As a basic principle, with regard to reducing the risks of injury, such a belt, in which such a type of fabric is only used in the sections of belt which lie directly against the body of the vehicle occupant, e.g. against the chest area, would appear to be sufficient.

BRIEF DESCRIPTION OF THE DRAWINGS

The invention is explained in more detail hereinunder with reference to the exemplified embodiments illustrated schematically in the drawings, in which:

FIG. 1 shows an exemplary illustration of the fundamental construction of a belt fabric;

FIG. 2 shows an illustration of the construction of a load-free belt fabric in accordance with the invention.

DETAILED DESCRIPTION

Figure 3:
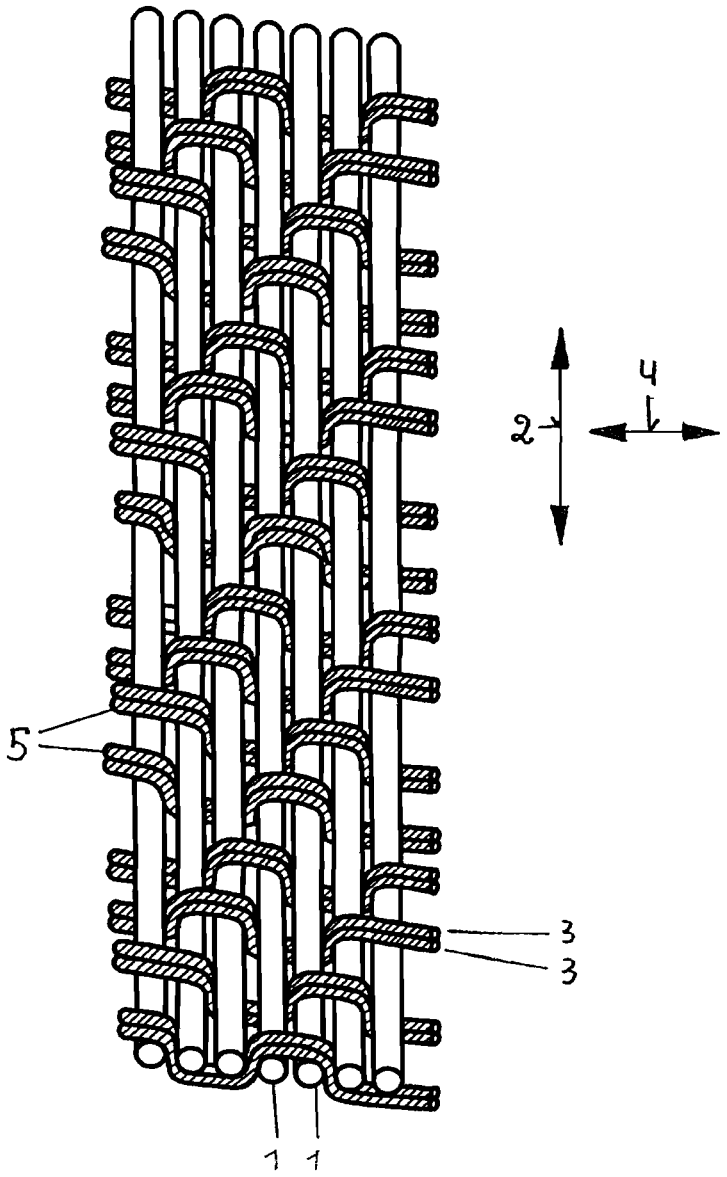
FIG. 3 shows an illustration of the belt fabric in accordance with FIG. 1 which is subjected to a loading in the direction of the belt length.

The belt fabric in accordance with FIG. 1 shows the type of weave between the warp threads 1 which run in the lengthwise direction 2 of the belt and the weft threads 3 which run transverse to the warp threads 1. It is evident that the weft threads 3 are each present in a double arrangement 5 and that a warp thread 1 loops in each case two such successive arrangements 5. It is further evident that the warp threads 1 which follow each other successively in a transverse direction 4 are disposed offset with respect to each other in the lengthwise direction 2 in each case around such an arrangement 2.

FIG. 1 shows, merely to clarify the fabric construction, in particular the warp threads 1 in an arrangement which lies comparatively wide apart. In an actual product illustrated in FIG. 2, the warp threads 1 lie close together, wherein, by reason of the arrangement offset in the lengthwise direction 2 of the warp threads 1 lying one by the side of the other, a characteristic surface structure is produced.

In FIGS. 2 and 3, features which are identical to those in FIG. 1 are identified accordingly, which means that a description in this respect need not be repeated.

FIGS. 1 and 2 show the belt fabric in the load-free state. It is evident that under this condition the warp threads 1 loop the weft threads 3, i.e. the warp threads are present in an uniform looped configuration within the fabric. This applies to the same extent for all warp threads 1. It is further evident, that the weft threads 3 in the arrangements 5, on the other hand, run in a substantially straight line, i.e. for their part they are not looped around the warp threads 1 in any case.

In the case of this fabric structure in which the windings of the warp threads in the unloaded state are characterised by the offsetting in the longitudinal direction, as described above, the warp threads are in addition displaced in the transverse direction 4, so that these run—seen in a plan view—in accordance with a slightly zigzag structure. Moreover, the warp threads 1 extend within the belt fabric always in its longitudinal direction 2, thus in the direction in which the belt has to absorb forces during an accident.

In accordance with the invention the warp threads 1 consist of a material which is generally used for this purpose and which is not able or is hardly able to extend in length, in contrast to which the weft threads 3 have a considerable ability in comparison to extend in length. An increased ability to extend in length can be demonstrated by selecting the material accordingly, by virtue of measures concerning the structure of the yarns used for the threads or also by virtue of combinations of these two fundamental options.

Where loading occurs in the lengthwise direction 2, which is mainly to be absorbed via the warp threads 1, these warp threads are, as illustrated in FIG. 3, stretched in comparison to the state illustrated in FIG. 2, so that in the unloaded state their structure looped around the weft threads 3 is now aligned in a straight line. This now causes the weft threads 3 in the extended state to surround the warp threads 1, whereby in each case a weft thread 3 or an arrangement 5 of weft threads 3 is displaced between two warp threads 1, so that the warp threads 1 are moved apart from each other in the transverse direction 4 by this amount. This in turn leads to an increase in the width dimension of the belt.

Such a change in width therefore does not occur in the case of a belt fabric which is assigned to the prior art because the material from which the weft threads 3 are made, in the identical manner as that of the warp threads, is not able or is hardly able to stretch, so that the weft threads which are not able to extend in length positively prevent the belt from increasing in width under loading, since the loopy structure of the warp threads in such a fabric is also to be regarded virtually as unchangeable even under loading.

The drawings show a belt fabric on the basis of a twill weave K2/2. However, the invention is not limited to such a weave and fundamentally can be used in all weaves known to the person skilled in the art in the field of weaving technology for use in belts of this type.

It is evident that by using a belt fabric in accordance with the invention the performance characteristics of vehicle safety belts can be further improved, since during an accident the loading can cause the belt to widen and thus increase its contact surface on the body of the vehicle occupant, with the result that the risks of injury are correspondingly reduced.

LIST OF DESIGNATIONS

1. Warp thread
2. Lengthwise direction
3. Weft thread
4. Transverse direction
5. Arrangement

The invention claimed is:

1. A vehicle safety belt having a length extending in a longitudinal direction and a width extending in a transverse direction with the length substantially greater than the width, the vehicle safety belt configured for attachment with a vehicle safety system such that the longitudinal direction corresponds to a load direction of the belt, the vehicle safety belt comprising:

a fabric structure having warp threads and weft threads, the warp threads extending in the longitudinal direction corresponding to the load direction of the vehicle safety belt and the weft threads extending in the transverse direction thereto;

the vehicle safety belt having a load-free state where the warp threads are looped around the weft threads and the weft threads extend substantially in a straight line with respect thereto, and wherein at least in one length-wise section of the vehicle safety belt the weft threads are formed in such a manner as to be able to extend in length in comparison to the warp threads; and wherein the ability of the weft threads to extend in length is set such that in the event that a load is applied in the longitudinal direction, the warp threads are stretched substantially in a straight line from their structure looped around the weft threads and the weft threads from their substantially straight-line structure are looped around the warp threads and said warp threads are displaced laterally and in this case increase the width dimension of the vehicle safety belt.

2. The vehicle safety belt as claimed in claim 1, wherein the weft threads are formed by elastic threads.

3. The vehicle safety belt as claimed in claim 1, wherein the weft threads are formed from threads which are conditioned by means of partial stretching so as to be able to extend in length.

4. The vehicle safety belt as claimed in claim 1, wherein the weft threads are conditioned by means of woven-in loops so as to be able to extend in length.

5. The vehicle safety belt as claimed in claim 3, wherein the weft threads are formed in an identical material to the warp threads.

6. The vehicle safety belt as claimed in claim 2, wherein the weft threads are formed from threads which are conditioned by means of partial stretching so as to be able to extend in length.

7. The vehicle safety belt as claimed in claim 2 wherein the weft threads are conditioned by means of woven-in loops so as to be able to extend in length.

8. The vehicle safety belt as claimed in claim 3 wherein the weft threads are conditioned by means of woven-in loops so as to be able to extend in length.

9. The vehicle safety belt as claimed in claim 4, wherein the weft threads are formed in an identical material to the warp threads.

10. The vehicle safety belt as claimed in claim 1, wherein the weft threads are formed from threads which are conditioned by means of texturing so as to be able to extend in length.

11. The vehicle safety belt as claimed in claim 1, wherein the weft threads are formed from threads which are conditioned by means of partial stretching and texturing so as to be able to extend in length.

12. The vehicle safety belt as claimed in claim 2, wherein the weft threads are formed from threads which are conditioned by means of texturing so as to be able to extend in length.

13. The vehicle safety belt as claimed in claim 2, wherein the weft threads are formed from threads which are conditioned by means of partial stretching and texturing so as to be able to extend in length.

* * * * *